US007255158B2

(12) United States Patent
Ozaki

(10) Patent No.: US 7,255,158 B2
(45) Date of Patent: Aug. 14, 2007

(54) HEAT EXCHANGER

(75) Inventor: Tatsuo Ozaki, Okazaki (JP)

(73) Assignee: DENSO Corporation, Kariya (JP)

( * ) Notice: Subject to any disclaimer, the term of this patent is extended or adjusted under 35 U.S.C. 154(b) by 45 days.

(21) Appl. No.: 11/325,681

(22) Filed: Jan. 4, 2006

(65) Prior Publication Data

US 2006/0151158 A1 Jul. 13, 2006

(30) Foreign Application Priority Data

Jan. 6, 2005 (JP) ..... 2005-001920

(51) Int. Cl.
*F28F 9/02* (2006.01)

(52) U.S. Cl. ..... 165/173; 165/149

(58) Field of Classification Search ..... 165/148, 165/149, 151–153, 172, 173, 175, 81
See application file for complete search history.

(56) References Cited

U.S. PATENT DOCUMENTS 4,582,127 A * 4/1986 Moranne ..... 165/83
4,881,594 A * 11/1989 Beamer et al. ..... 165/173
5,492,172 A * 2/1996 Laveran et al. ..... 165/173
5,996,633 A * 12/1999 Kato ..... 165/153
6,305,465 B1 * 10/2001 Uchikawa et al. ..... 165/140
6,357,521 B1 * 3/2002 Sugimoto et al. ..... 165/173

FOREIGN PATENT DOCUMENTS

| | | |
|---|---|---|
| JP | 4-92175 | 8/1992 |
| JP | 3059971 | 4/1999 |
| JP | 11-142090 | 5/1999 |

* cited by examiner

*Primary Examiner*—Teresa J. Walberg
(74) *Attorney, Agent, or Firm*—Harness, Dickey & Pierce, PLC

(57) ABSTRACT

A protruding portion protruding toward the outside a tank is formed on a core plate in a range corresponding to a straight portion of a flat tube inserted and joined to the core plate. Due to this structure, a joining portion of the tube to the core plate is three-dimensionally formed and a joining portion length is extended. Therefore, thermal stress generated in the tube can be diffused from the joining portion of the tube to the core plate.

4 Claims, 7 Drawing Sheets

HEAT EXCHANGER

TECHNICAL FIELD

The present invention relates to a heat exchanger for exchanging the heat of a fluid. More particularly, the present invention relates to a heat exchanger preferably applied to a radiator for radiating the heat, of the cooling water of a water-cooled engine, into the atmosphere.

BACKGROUND ART

In a conventional heat exchanger, a core portion is composed by alternately laminating a large number of tubes and corrugated fins on each other. End portions of tubes in the longitudinal direction are inserted and joined to insertion holes formed in a core plate portion attached to a tank. In order to reinforce the core portion, side plates are arranged at both end portions of the core portion in the direction of tube lamination. Concerning this technique, refer to the official gazette of Japanese Utility Model Registration No. 3059971 and the official gazette of JP-A-11-142090.

In this connection, in the case where this heat exchanger is applied to a radiator for vehicle use, engine cooling water does not flow in the side plates but flows in the tubes. The side plates are joined to corrugated fins and cooled by a blast of cooling wind. Therefore, a difference in temperature is generated between the tubes and the side plates. Therefore, a difference in thermal expansion is caused between the tubes and the side plates.

Further, in the case where a volume of cooling wind fluctuates in each part of the core portion, differences in temperature are caused among a large number of tubes according to the positions at which the tubes are arranged. Accordingly, differences in thermal expansion are caused among the tubes.

As a portion for absorbing differences in thermal expansion between the tubes and the side plates is provided in the heat exchanger shown in the above Patent Document, the stress generated by the differences in thermal expansion between the tubes and the side plates can be reduced.

However, it is impossible to absorb all the differences in thermal expansion among the tubes. Therefore, stress caused by differences in thermal expansion among the tubes is generated. Accordingly, when it is attempted to reduce the wall thickness of the tubes as compared with the present wall thickness, there is a possibility that the tubes are broken at the join between the tubes and the core plates by the stress generated by the difference in thermal expansion. Accordingly, there is a possibility that the life of the tubes is deteriorated. For the above reasons, it is impossible to further reduce the wall thickness of the tubes.

DISCLOSURE OF THE INVENTION

The present invention has been accomplished to solve the above problems. It is an object of the present invention to provide a heat exchanger in which deterioration of the life of each tube can be prevented even when wall thickness of each tube is reduced.

In order to accomplish the above object, according to a first aspect of the present invention, there is provided a heat exchanger comprising:

a plurality of tubes (132), the shapes of which are flat, laminated on each other;

a core plate portion (140) extended in a laminating direction (Y) of the plurality of tubes (132), into the insertion holes (142) of which end portions of the tubes (132) in the longitudinal direction (X) are inserted and joined; and tanks (110, 140) communicated with the plurality of tubes (132), wherein a cross-section perpendicular to the longitudinal direction (X) of the tube (132) includes a pair of straight portions (132*a*) opposed to each other and a wall face portion (132*b*) for connecting end portions of the pair of straight portions (132*a*) to each other, a protruding portion (145) extending in the laminating direction (Y) is formed toward the outside of the tank (110, 140) in a region of the core plate portion (140), in which the insertion hole (142) is formed, corresponding the straight portion (132*a*), and a straight portion joining portion (142*a*) of the insertion hole (142) is located on the outside of the tank (110, 140) with respect to a wall face portion joining portion (142*b*) of the insertion hole (142).

According to the present invention, it is possible to extend a length of a joining portion of a tube (132) to a core plate portion (140) compared with a case in which a protruding portion is not provided in the core plate portion (140). Accordingly, stress generated in the tube (132) can be diffused at the joining portion of the tube (132) to the core plate portion (140). Therefore, even when the wall thickness of the tube (132) is reduced, deterioration of the breaking life of the tube (132) can be suppressed.

Incidentally, the reference numerals in parentheses, to denote the above means, are intended to show the relationship of the specific means which will be described later in an embodiment of the invention.

The present invention may be more fully understood from the description of preferred embodiments of the invention set forth below, together with the accompanying drawings.

BEST MODE FOR CARRYING OUT THE INVENTION

Figure 1:
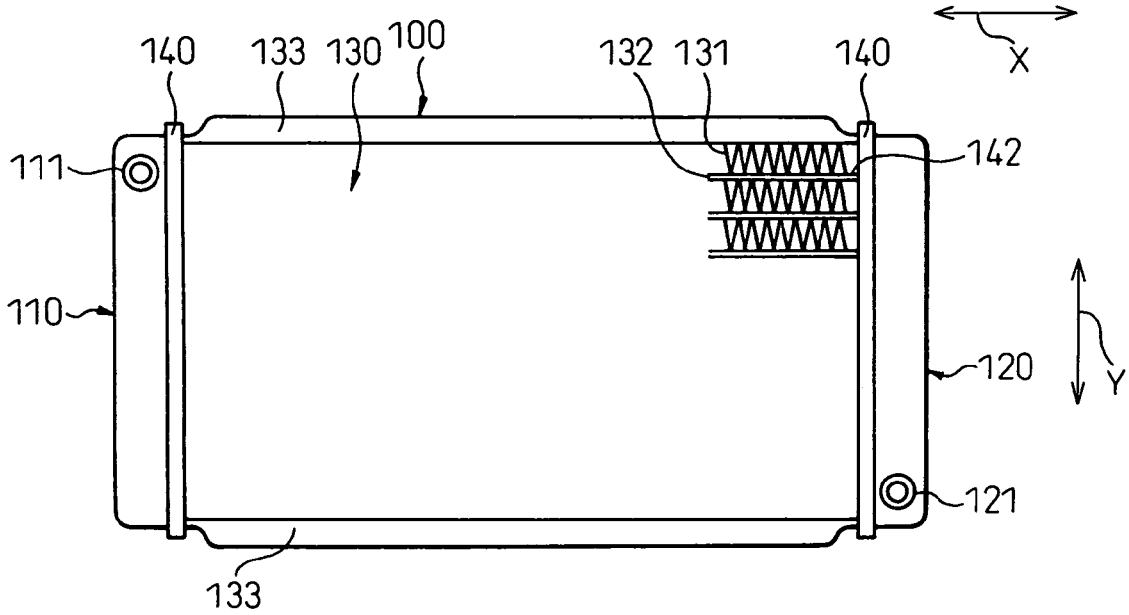
FIG. 1 is a front view showing an outline of a structure of a radiator 100 which is a heat exchanger of the first embodiment to which the present invention is applied.

By referring to the drawings, an embodiment of the present invention will be explained below.

Figure 2:
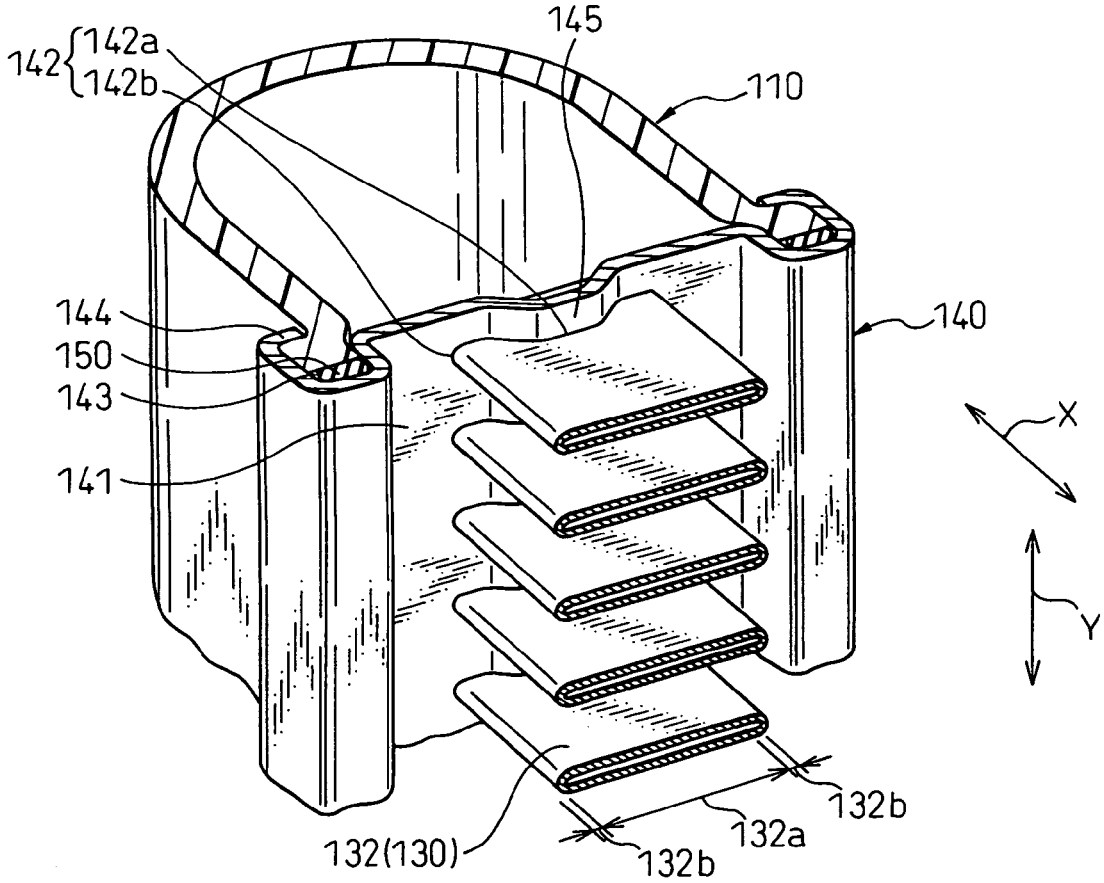
FIG. 2 is a perspective view showing a primary portion of a join between a tank and a tube of the radiator 100.

First of all, explanations will be made into the first embodiment. FIG. 1 is a front view showing an outline of a structure of a radiator 100 which is a heat exchanger of the first embodiment to which the present invention is applied. FIG. 2 is a perspective view showing a primary portion of a join between a tank and a tube of the radiator 100. In this view, a portion is shown as a cross-section.

A radiator 100 shown in FIG. 1 is a radiator, for automobile use, mounted in a front portion in an engine compartment. The radiator 100 is of a so-called cross-flow type in which cooling water flows from the left to the right in tubes 132 of a core portion 130 in the drawing. The radiator 100 basically includes: a core portion 130; a left tank 110; and a right tank 120.

The core portion 130 is a heat exchanging portion in which cooling water is circulated and cooled. The core portion 130 includes: fins 131; tubes 132; side plates 133; and core plates 140. Each fin 131 is formed into a corrugated shape out of a thin strip sheet. Slit-shaped louvers (not shown) are provided inside the fin 131.

Each tube 132 is composed in such a manner that a thin strip sheet is bent into a shape so that the cross-section can be formed into a flat shape, and end portions are welded to each other. The above fins 131 and the tubes 132 are alternatively laminated on each other in the vertical direction in FIG. 1, and side plates 133 functioning as reinforcement members, the cross-sections of which are formed into C-shape, are contacted to the outside of the uppermost and the lowermost fin 131.

The core plate 140 is formed out of a flat plate by means of drawing and arranged in the laminating direction Y of the tubes 132. On the core plate 140, a plurality of insertion holes 142, into which the tubes are inserted, are provided at positions corresponding to end portions of the tubes 132 in the longitudinal direction X. These end portions of the tubes 132 in the longitudinal direction X will be referred to as tube end portions hereinafter. The tube 132 end portions are inserted into these holes 142 and the core portion 130 is composed.

Members composing the core portion 130 are made of aluminum alloy, the mechanical characteristic and the anti-corrosion property of which are excellent. When these members are integrally brazed to each other, the core portion 130 is formed.

A left tank 110 is mechanically connected to a left core plate 140 by means of caulking, and a right tank 120 is mechanically connected to a right core plate 140 by means of caulking.

Both the left tank 110 and the right tank 120 are made of resin (polyamide in this embodiment).

In this connection, an inlet pipe 111 is integrally attached to the left tank 110, and an outlet pipe 121 is integrally attached to the right tank 120. As the structure of the left tank 110 and that of the right tank 120 are substantially the same, the structure of the primary portion of the present embodiment will be explained for the left tank 110.

As shown in FIG. 2, a cross-sectional shape of the left tank 110 made of resin is formed substantially into a U-shape. The left tank 110 is formed into a box-shaped container having an opening portion on the container plate 140 side. An opening side end portion of the left tank 110 is inserted into an attaching groove portion (tank receiving groove) 143 which is formed in an outer circumferential portion of the core plate 140, and packing 150, which is a sealing member, is attached inside the attaching groove portion (tank receiving grooves) 143. The opening side end portion is caulked by a caulking pawl 144 of the core plate 140.

That is, the tank 110 and the core plate 140 compose a substantial tank in the present embodiment. A tube 132 end portion is joined to the core plate 140 which is a substantial core plate portion (a side portion of the core portion 130). Therefore, the tube 132 and a space in the tank are communicated with each other.

A region inside the attaching groove portion 143 of the core plate 140 composes a bottom face portion 141 on the core portion 130 side of the substantial tank formed by the tank 110 and the core plate 140. The bottom face portion 141 is a reference face portion of the core plate 140.

Figure 3:
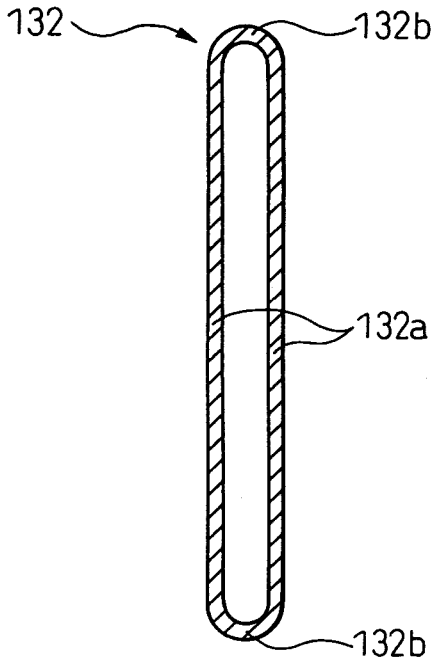
FIG. 3 is a sectional view of a tube 132 in a direction perpendicular to the longitudinal direction of the tube 132.

The tube 132 joined to the core plate 140 is a flat tube as described before. As a cross-sectional shape of the tube 132 in a direction perpendicular to the longitudinal direction is shown in FIG. 3, the tube 132 includes: a pair of straight portions 132*a* opposed to each other; and a pair of rounded portions (corresponding to wall face portions) for connecting end portions of the pair of straight portions 132*a*.

Figure 4:
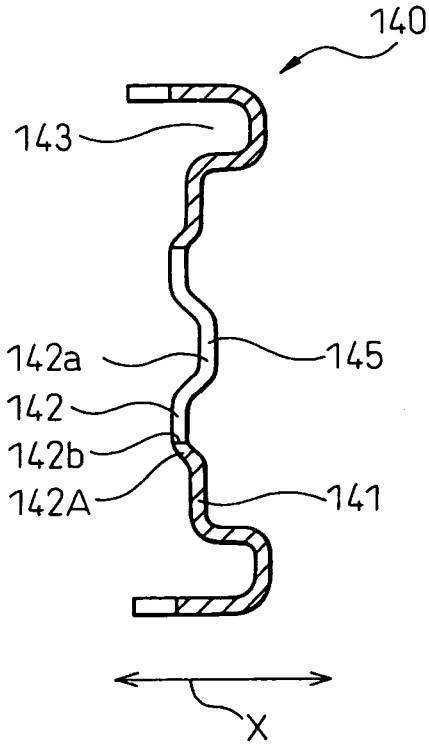
FIG. 4 is a sectional view of a core plate 140 in a direction perpendicular to a tube laminating direction.

FIG. 4 is a sectional view of the core plate 140 in a direction perpendicular to the tube laminating direction Y. In FIG. 4, a cross-section of the insertion hole 142 forming portion is shown. In this connection, in the sectional view, only the core plate 140 is shown before it is caulked to the tank 110.

As shown in FIG. 4, on the core plate 140, in a range corresponding to the straight portion 132*a* of the tube 132 to be inserted in a region of the bottom face portion 141 in which the insertion hole 142 is formed, a protruding portion 145 is formed, the cross-section of which is a substantial trapezoid, which protrudes to the outside of the tank (to the center side of the core portion 130).

In this connection, as can be seen in FIG. 2, this protruding portion 145 is formed on the core plate 140 being extended in the tube laminating direction Y.

Accordingly, as shown in FIG. 2, the joining portion 142*a* of the straight portion 132*a* of the tube 132 in the insertion hole 142 is formed being located on the outside of the tank (on the center side of the core portion 130) with respect to the joining portion 142*b* of the rounded portion 132*b* of the tube 132 in the insertion hole 142.

Further, as shown in FIG. 4, on the core plate 140, in the portion corresponding to the rounded portion 132*b* of the tube 132 to be inserted into the insertion hole 142, an edge portion of the insertion hole 142 is subjected to burring, and a burring portion 142A, which is raised to the inside of the tank, is formed.

Accordingly, the joining portion 142*b* of rounded portion 132*b* of the tube 132 in the insertion hole 142 is located at a position closer to the inside of the tank 110 than to the bottom face portion 140. Therefore, a distance between the joining portion 142*b* of R portion 132*b* of the tube 132 and the joining portion 142*a* of the straight portion is extended and an area of brazing R portion joining portion 142*b* is increased.

According to the above structure, a protruding portion 145, which protrudes toward the outside of the tank and extends in the tube laminating direction Y, is formed in the region, in which the insertion hole 142 is formed, corresponding to the straight portion 132*a* of the tube 132.

Due to the foregoing, the tube straight portion joining portion 142*a* of the insertion hole 142 is formed on a side closer to the outside of the tank than the tube R portion joining portion 142*b* of the insertion hole 142.

Therefore, as compared with a structure in which no protruding portion is provided on the core plate 140, the connecting portion of the tube 132 with the core plate 140 is three-dimensionally formed and the joining portion length can be extended. In this way, it is possible to diffuse thermal stress, which is generated in the tube 132, at the joining portion of the tube 132 with the core plate 140. Accordingly, the life of the tube 132 can be enhanced.

When the protruding portion 145 is provided, the tube 132 is three-dimensionally supported at the joining portion of the core plate 140 to the tube 132. Therefore, even when the tube 132 receives stress in a direction inclined to the bottom face portion 141 of the core plate 140, stress concentration upon rounded portion 132*b* of the tube 143 can be easily reduced.

Accordingly, when the tube 132 is given not only thermal stress but also stress caused by vibration, the given stress can be diffused. Therefore, the life of the tube 132 can be enhanced.

A shape of the cross-section of the protruding portion 145 formed on the core plate 140 in a direction perpendicular to the tube laminating direction Y is substantially trapezoidal. Therefore, the protruding portion 145 can be easily formed by means of press forming.

A portion of the insertion hole 142 corresponding to the tube 132 R portion 132*b* is formed on the bottom face portion 141, the shape of which is substantially a plane. Accordingly, as compared with a case in which the portion of the insertion hole 142 corresponding to the tube 132 rounded portion 132*b* is formed on an inclined face of the protruding portion 145, accuracy of the shape can be easily maintained high. Due to the foregoing, the working property of inserting the tube 132 end portion into the core plate 140 insertion hole 142 can be enhanced.

The tube rounded portion joining portion 142*b* of the insertion hole 142 is formed into a burring portion 142A in which an edge portion of the insertion hole 142 of the core plate 140 is raised toward the inside of the tank. Accordingly, a distance in the tube longitudinal direction X between the tube straight portion joining portion 142*a* and the tube rounded portion joining portion 142*b* can be easily ensured to be large. Therefore, as compared with a case in which no burring portion is provided in the connecting portion of the tube 132 with the core plate 140, the structure can be more three-dimensionally composed and it is possible to extend the joining portion length. In the burring portion 142A, when a brazing material fillet of the tube rounded portion joining portion 142*b* is formed being extended so as to ensure a large brazing area, it is possible to enhance the reliability of joining.

Next, referring to FIGS. 5 and 6, the second embodiment will be explained below.

In this second embodiment, the insertion property of inserting the tube end portion into the insertion hole is further enhanced as compared with the first embodiment described before.

In this connection, similar reference characters are used to indicate similar parts in the first and the second embodiment, and the explanations are omitted here.

Figure 5:
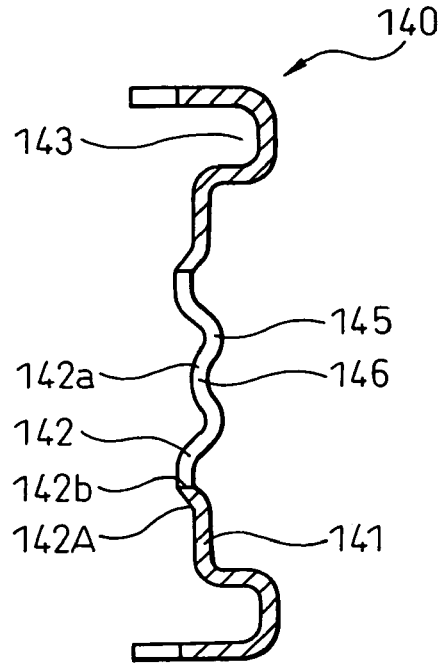
FIG. 5 is a sectional view of the core plate 140 in a direction perpendicular to the tube laminating direction in the second embodiment.

As shown in FIG. 5, a recess portion 146, which sinks inward with respect to the tank, is formed at the center in the vertical direction in the drawing of the protruding portion 145, the cross-section of which is formed into a substantial trapezoid, formed on the core plate 140.

That is, the recess portion 146 is formed in a portion of the core plate portion 140 protruding portion 145 corresponding to the center of the tube straight portion 132*a*.

Figure 6:
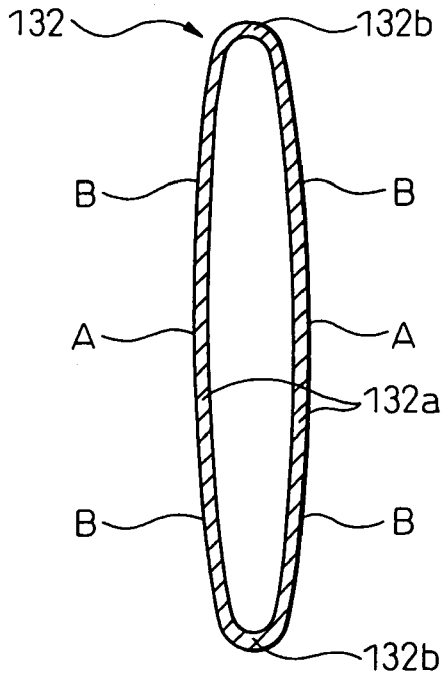
FIG. 6 is a sectional view of the tube 132 before it is inserted into an insertion hole 142 of the core plate 140.

In order to make the fin 131 come into tight contact with an outer face of the straight portion 132*a* of the tube 132, before the tube 132 is inserted into the insertion hole 142 of the core plate 140, as in an outline of the cross-sectional shape of the tube 132 is shown in FIG. 6, the straight portion 142*a* of the tube 132 is somewhat swelled outside and the central portion A is protruded to the most outside, that is, a cross-section of the tube 132 is formed substantially into a oval.

Therefore, according to the present embodiment, when the flat tube 132, the cross-section of which is substantially an oval shape, is inserted into the insertion hole 142, at the beginning of insertion, the most protruding portion A (the outermost portion in a direction of the minor axis of the oval shape) of the tube straight portion 132*a* does not come into contact with the core plate 140, and the point B, the width in the minor axis direction of which is smaller than that of the point A, comes into contact with the core plate 140.

After the point B has come into contact with the core plate 140, the tube 132 is successively inserted into the insertion hole 142. According to the insertion of the point B, the straight portion 132*a* is pushed inside, and the width in the minor axis direction at the point A is reduced. Consequently, the tube 132 can be easily inserted into the insertion hole 142. In this way, the insertion property of the flat tube 132, the cross-sectional shape of which is a substantial oval, into the insertion hole 142 can be enhanced.

Finally, another embodiment will be explained below. In each embodiment described above, the cross-sectional shape of the protruding portion 145 of the core plate 140 in the direction perpendicular to the tube laminating direction Y is a substantial trapezoid. However, it should be noted that the shape of the protruding portion is not limited to the above specific shape.

Figure 7A:
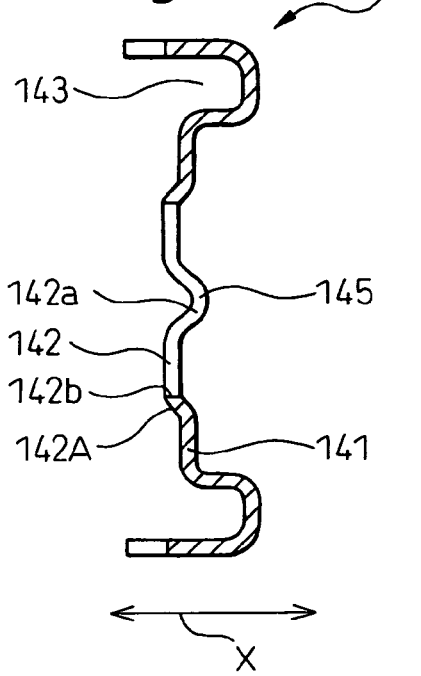
FIG. 7A is a sectional view of the core plate in another embodiment.
Figure 7B:
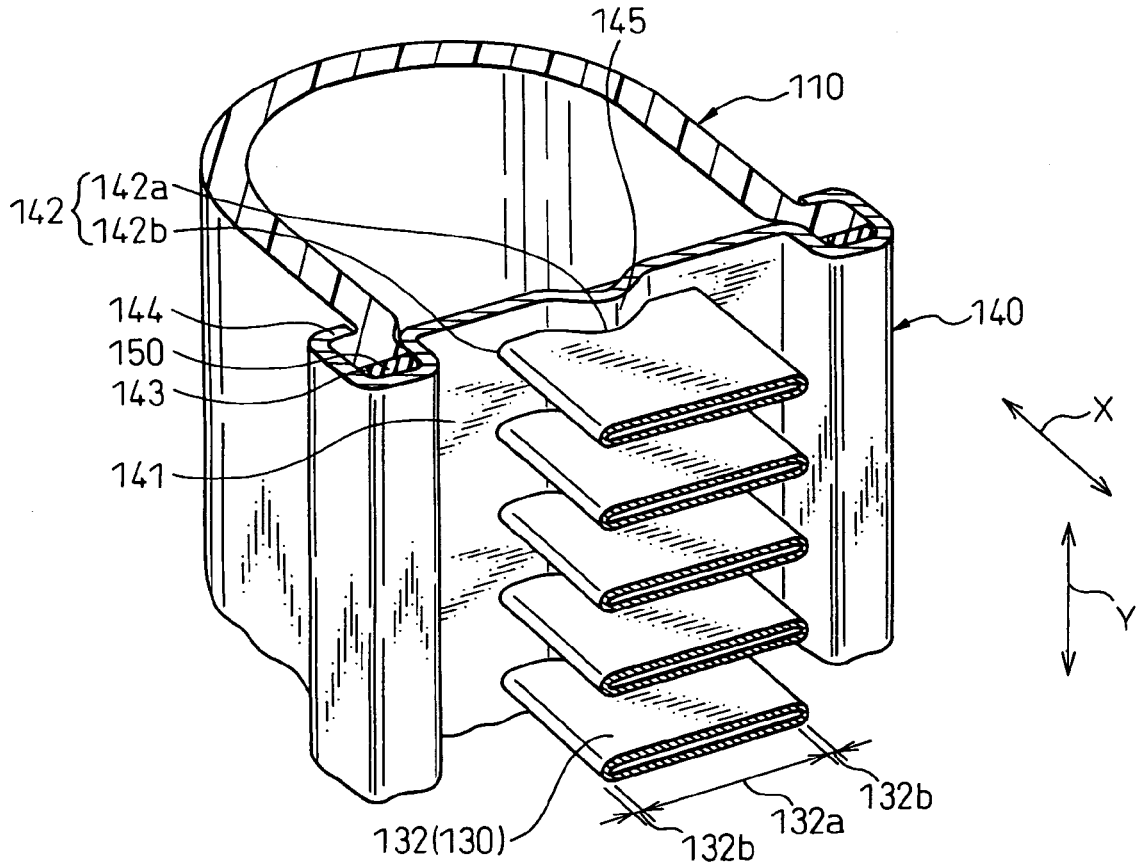
FIG. 7B is a perspective view of a primary portion of a join between the tank and the tube.
Figure 8A:
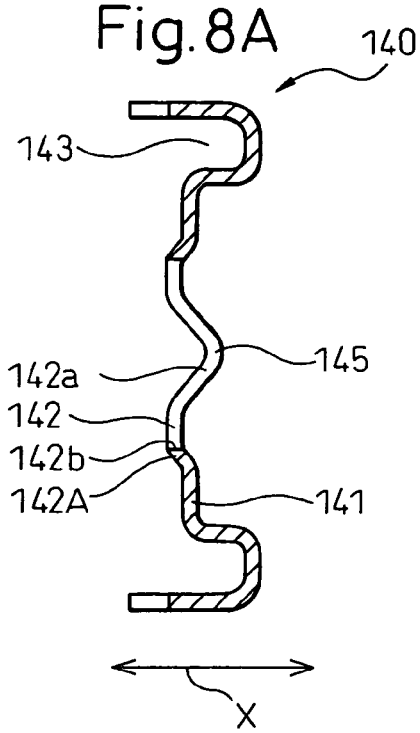
FIG. 8A is a sectional view of the core plate in another embodiment.
Figure 8B:
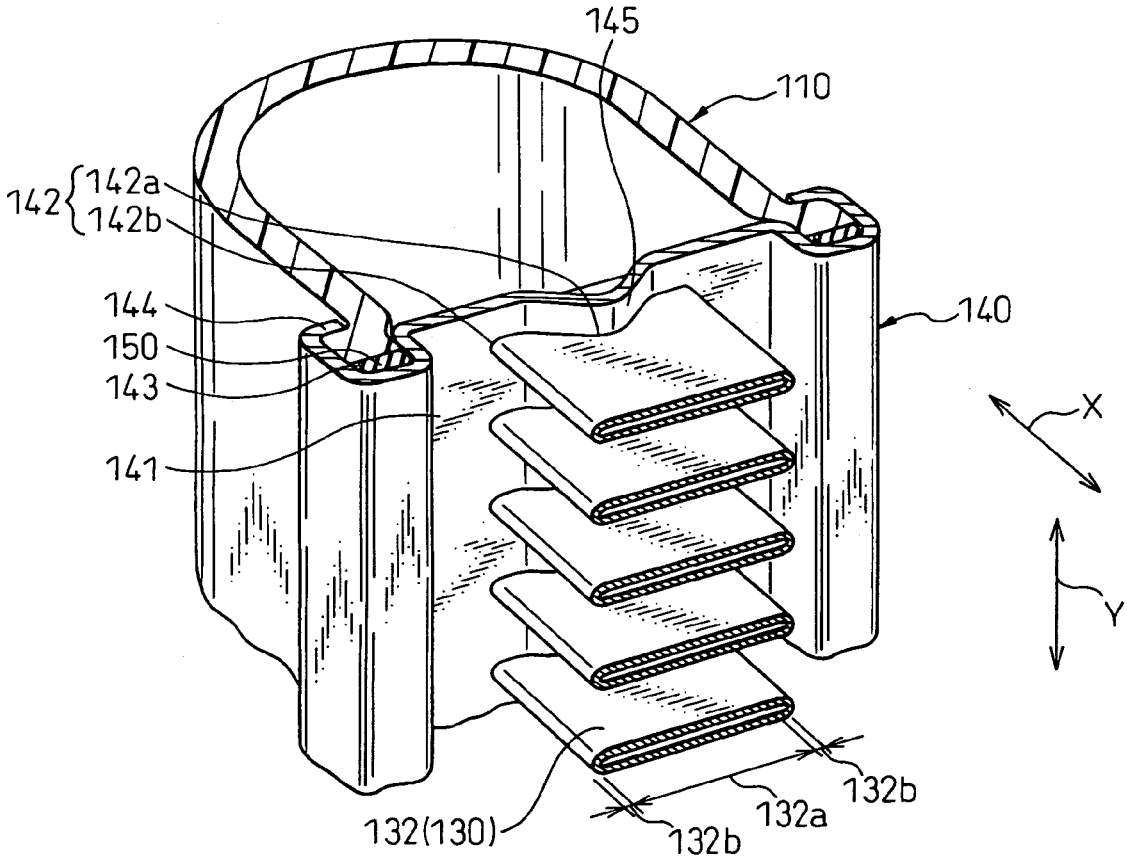
FIG. 8B is a perspective view of the primary portion of a join between the tank and the tube.

For example, as shown in FIG. 7A which is a sectional view of the core plate, and also as shown in FIG. 7B which is a perspective view of the primary portion of the joining portion of the tank with the tube, a cross-sectional shape of the protruding portion 145 in a direction perpendicular to the tube laminating direction Y may be substantially an arcuate shape. As shown in FIG. 8A which is a sectional view of the core plate and also shown in FIG. 8B which is a perspective view of the primary portion of the joining portion in which the tank is joined to the tube, a cross-sectional shape of the protruding portion 145 in a direction perpendicular to the tube laminating direction Y may be substantially an arcuate shape, the inclined face of which is extended. That is, the cross-sectional shape of the protruding portion 145 may be substantially triangular.

Figure 9:
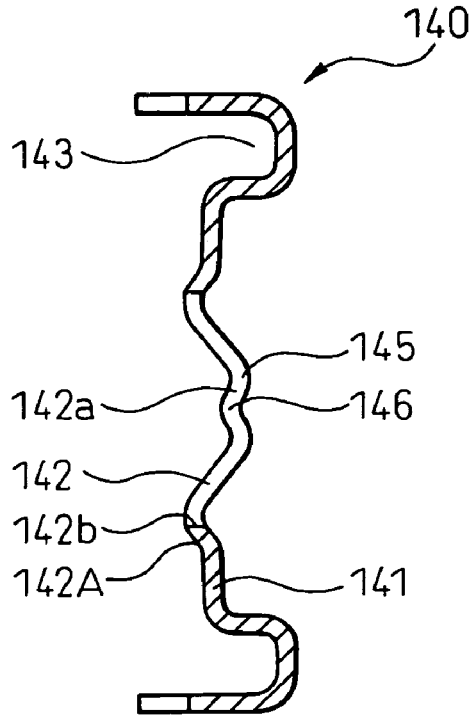
FIG. 9 is a sectional view of the core plate in another embodiment.

In the second embodiment described above, the recess portion 146 is provided in the protruding portion 145, the cross-sectional shape of which is substantially trapezoid. However, the recess portion 146 may be provided in a protruding portion, the shape of which is another shape. For example, as shown in FIG. 9 which is a sectional view of a core plate, a recess portion 146 may be formed in a protruding portion 145, the shape of which is substantially an arcuate shape having long inclined faces. That is, the recess portion 146 may be formed in the protruding portion 145, the shape of which is substantially a triangular shape.

Figure 10:
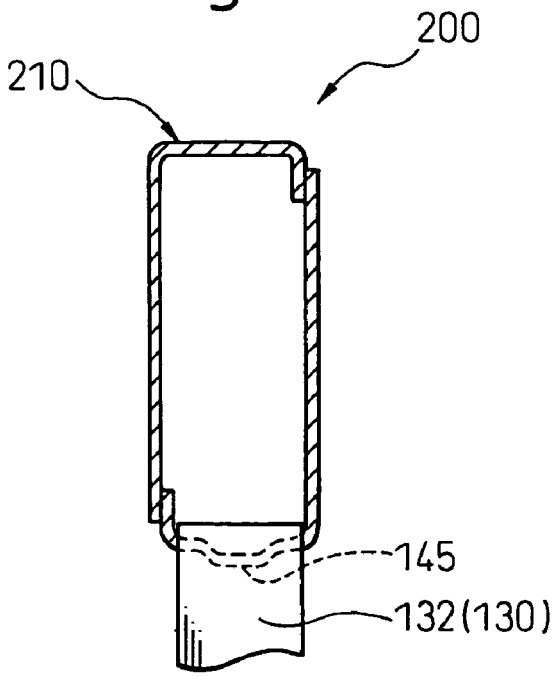
FIG. 10 is a sectional view of the primary portion in another embodiment.

In each embodiment described above, the present invention is applied to the radiator 100 having tanks 110, 120 made of resin. However, for example, as a cross-section of the primary portion is shown in FIG. 10, the present invention can be applied to a radiator 200 having a tank 210 in which plate members made of metal (for example, made of aluminum alloy) are combined with each other and a cross-section of the primary portion is shown in FIG. 10. In this case, a face portion, onto which the tube end portion 132 of the tank 210 is inserted and joined, corresponds to the core plate portion described in the present invention. As long as the protruding portion 145 is formed in this core plate portion, the present invention can be applied to any radiator.

Figure 11:
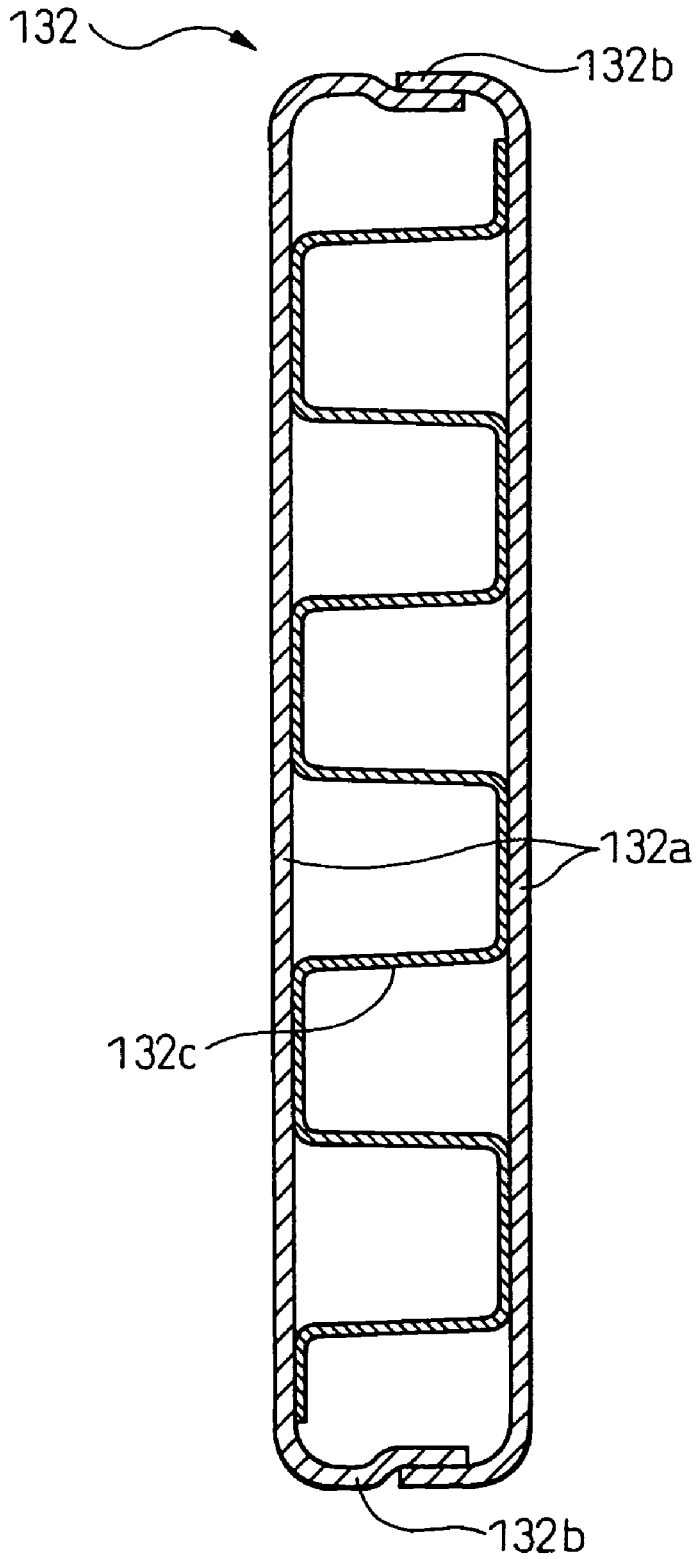
FIG. 11 is a sectional view of the tube in another embodiment.

In each embodiment described above, the cross-sectional shape of the tube 132, the end portion of which is connected to the core plate 140, includes: a pair of straight portions 132*a*; and a pair of rounded portions 132*b* for connecting end portions of the pair of straight portions 132*a* to each other. However, it should be noted that the tube shape is not limited to the above specific shape. For example, as a cross-section of a tube 132 is shown in FIG. 11, plate members, the cross-sections perpendicular to the longitudinal direction of which are formed substantially into a C-shape, are combined and joined to each other, and a cross-section of the tube 132 is formed substantially into a rectangle which includes a pair of straight portions 132*a* and a pair of wall face portions 132*b* for connecting end portions of the pair of straight portions 132*a* to each other. Further, the tube 132 includes inner fins 132*c* on the inside. The present invention can be applied even to this structure.

In each embodiment described above, the radiator 100 is of a so-called cross-flow type. However, the present invention can be applied to a radiator of a so-called vertical-flow type in which cooling water flows from top to bottom. However, generally speaking, the tubes of the cross-flow-type radiator are longer than those of the vertical-flow-type radiator. Therefore, stress caused by a difference in thermal expansion between the tubes tends to increase in the tubes of the cross-flow-type radiator. Therefore, a great effect can be provided when the present invention is applied to the cross-flow-type radiator.

In each embodiment described above, the present invention is applied to a radiator. However, it is possible to apply the present invention to a heat exchanger except for the radiator. For example, it is possible to apply the present invention to an inter-cooler, an oil cooler, an EGR gas cooler and so forth.

While the invention has been described by reference to specific embodiments chosen for purposes of illustration, it should be apparent that numerous modifications could be made thereto, by those skilled in the art, without departing from the basic concept and scope of the invention.

The invention claimed is:

1. A heat exchanger comprising:

a plurality of tubes, the shapes of which are flat, laminated on each other;

a core plate portion extended in a laminating direction of the plurality of tubes, into the insertion holes of which end portions of the tubes in the longitudinal direction are inserted and joined; and tanks communicated with the plurality of tubes, wherein a cross-section perpendicular to the longitudinal direction of the tube includes a pair of straight portions opposed to each other and a wall face portion for connecting end portions of the pair of straight portions to each other, a protruding portion extending in the laminating direction is formed toward the outside of the tank in a region of the core plate portion, in which the insertion hole is formed, corresponding the straight portion, and a straight portion joining portion of the insertion hole is located on the outside of the tank with respect to a wall face portion joining portion of the insertion hole.

2. A heat exchanger according to claim 1, wherein the protruding portion is formed into a substantially trapezoidal shape or a substantially arcuate shape in a cross-section perpendicular to the laminating direction.

3. A heat exchanger according to claim 1, wherein an edge portion of the insertion hole of the core plate portion in the wall face joining portion of the insertion hole is formed into a burring portion.

4. A heat exchanger according to claim 1, wherein a recess portion is formed in a portion of the protruding portion corresponding to the center of the straight portion.

* * * * *